US005129444A

United States Patent [19]

Bafford

[11] Patent Number: 5,129,444

[45] Date of Patent: Jul. 14, 1992

[54] METHOD OF PLACING FLUID PASSAGE TUBING IN CAST PRODUCTS

[75] Inventor: Jerry E. Bafford, Decatur, Ill.

[73] Assignee: Wagner Castings Company, Decatur, Ill.

[21] Appl. No.: 762,855

[22] Filed: Sep. 18, 1991

Related U.S. Application Data

[63] Continuation of Ser. No. 373,396, Jun. 30, 1989, abandoned.

[51] Int. Cl.[5] ..... B22D 19/04

[52] U.S. Cl. ..... 164/112; 164/98

[58] Field of Search ..... 164/98, 112

[56] References Cited

FOREIGN PATENT DOCUMENTS 477323 12/1937 United Kingdom ..... 164/112

*Primary Examiner*—Kuang Y. Lin

*Attorney, Agent, or Firm*—Wallenstein, Wagner & Hattis, Ltd.

[57] ABSTRACT

The invention is a method of forming a passage haing a predetermined linear or non-linear shape in a ferrous casting, comprising four steps. First, a tube of a material compatible with the ferrous casting is secured to a generally cylindrical supporting ring to form a tube-containing ring. Second, this tube-containing ring is placed in a recess within a mold for the ferrous casting. Third, molten metal is poured into the mold to form the casting. Finally, the completed ferrous casting is removed from the mold when the molten metal has solidified.

6 Claims, 4 Drawing Sheets

METHOD OF PLACING FLUID PASSAGE TUBING IN CAST PRODUCTS

"This is a continuation of copending application Ser. No. 07/373,396 filed on Jun. 30, 1989, now abandoned.

TECHNICAL FIELD

This invention relates generally to an improved method of placing fluid passage tubing into cast products. In particular, it relates to a method of locating and placing tubing that facilitates the lubrication of automotive crankshafts and the like.

BACKGROUND OF THE INVENTION

The engine crankshafts of automobiles and light trucks have been formed of ductile and malleable iron castings for many years. In fact, in recent years, auto and light truck crankshafts have been almost exclusively made of such castings.

Holes for the passage of lubricant must be placed in the main bearing journals of these crankshafts. In addition, lubricant passages must be provided in the crankshafts for the passage of lubricant between these main bearing journals and the engine crankpins.

One method of manufacturing these passages is to drill them into the crankshaft after casting is completed. This method, however, has many inherent disadvantages. First, gun drilling centers of the kind needed for typical automotive production volumes are very costly to purchase, operate, and maintain.

Second, drilling is a slow process, and there is no foreseeable prospect for significantly improved drilling speeds. This is because center cutting drills require deep flutes for chip clearance. These deep flutes greatly reduce the cross-sectional area of the drill, and this reduction in turn severely limits the torque capacity of the drill and its resultant penetration rate.

Third, both the offset of the crankpin from the main bearing and the bearing width result in the need for the drill, to start the hole at a steep angle, i.e., an angle that is a considerable departure from the perpendicular to the bearing journal. Drills having the specialized points necessary to start a hole at this angle are not suitable for continued penetration of the lubricant passage. Hence, after the hole is initiated, the operator must substitute a more suitable drill for continued formation of the passage. Obviously, this is a time-consuming substitution, and adds to the expense of crankshaft manufacture.

Fourth, deburring and chamfering operations are very difficult in drilled passages whose open ends or holes are at a steep angle to the bearing surface. These holes appear to be somewhat oblong, not round, when viewed from the perpendicular to the bearing journal surface. The need to chamfer such holes with an orbital tool further adds to the cost of tooling such a crankshaft.

Finally, drilling is an inherently straight-line process. As a result, the actual location of a passage is inevitably a compromise between the location most suitable for the lubricant needs of the bearing, and the location that is possible given the capabilities of the drilling process used.

A second method of manufacturing these passages is to place a tube made of a metal, such as steel, into a mold prior to casting of a cast part. After securing this tube, the molten metal is placed into the mold. When the metal has cooled and solidified, the tube becomes an integral part of the casting. The tube within the casting acts as a lubricant passage One such method was described in U.S. Pat. No. 4,749,624, issued to George H. Pete and Jerry E. Bafford on Jun. 7, 1988, and entitled "Composite Ferrous Castings" (hereinafter the '624 patent) Other pertinent patents relating generally to the art described in the '624 patent include U.S. Pat. No. 3,170,452, issued to Dobovan in February, 1965; U.S. Pat. No. 4,008,052, issued to Vishnevsky et al. in February, 1977; and U.S. Pat. No. 4,209,058, issued to Spalding in June, 1980; and British Patent No. 2,073,633, issued in October, 1981.

Relevant methods are described in U.S. Pat. No. 1,729,848, issued to Charles M. Walker on Oct. 1, 1929; European Patent No. 0 110 234, issued on Jun. 13, 1984; and Swiss Patent No. 640 440, issued on Jan. 13, 1984.

These conventional methods have shortcomings, particularly in locating or placing the lubricant passage tubes within the mold of the parts to be cast prior to that casting. For example, in the method described in the '624 patent, the tubing can be oriented with or perpendicular to the parting plane of the mold.

Only a minor amount of offset in the tube is permitted by this and similar methods when orienting the axis of that tube perpendicular to the parting plane. If offset such as that between bearings of a crankshaft is necessary, then both ends of the tubing must be inserted within the normally receptive, or drag, mold half in conventional molding. In vertically parted molds, such as those using. Disamatic molding machines, both ends of the tubing must be placed within the impression formed by the ram or pressure plate.

SUMMARY OF THE INVENTION

The invention is a method of forming a passage having a predetermined linear or non-linear shape in a ferrous casting, comprising four steps. First, a tube of a material compatible with the ferrous casting is secured to a generally cylindrical supporting ring to form a tube-containing ring. Second, this tube-containing ring is placed in a recess within a mold for the ferrous casting. Third, molten metal is poured into the mold to form the casting. Finally, the completed ferrous casting is removed from the mold when the molten metal has solidified.

The invention is also an improved cast-in-tube product, including a casting made by the method described above.

It is an object of the present invention to provide an improved and more precise and flexible method of placing tubing within the mold of a part to be cast, prior to its casting. It is a further object of the invention to provide an improved casting, including a casting made by the method of the present invention.

DETAILED DESCRIPTION OF THE PREFERRED EMBODIMENT

Figure 1:
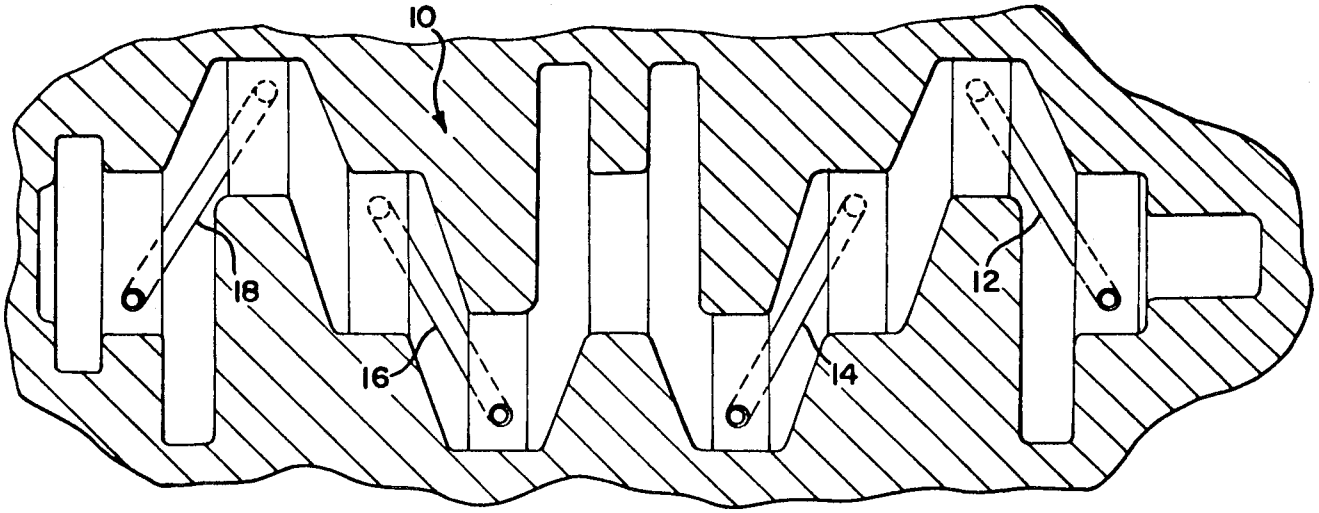
FIG. 1 is a plan view of a horizontal drag mold that may be used for the casting of a crankshaft for a four-cylinder automotive engine, and of a four-cylinder crankshaft after it has been cast.

While this invention is susceptible of embodiment in many different forms, there is shown in the drawings and will herein be described in detail preferred embodiments of the invention with the understanding that the present disclosure is to be considered an exemplification of the principles of the invention. It is not intended to limit the broad aspect of the invention to the embodiments illustrated.

The invention is a method of forming a passage having a predetermined linear or non-linear shape in a ferrous casting, comprising four steps. This passage is generally intended for the transport of a lubricant, such as motor oil, from one portion of a cast metal component to another. Although not intended to be limiting, for the purposes of explanation and this embodiment this description will pertain to the crankshaft of an automotive engine, including in-line four cylinder engines and V-type engines having either six or eight cylinders.

In such engines, the transport of lubricant from one area of the crankshaft to another is effected by passages within the crankshaft. For example, lubricant must be transported from any of the main bearings of the crankshaft to one or more of the crankpins In this embodiment, FIGS. 1-7 depict the invention as used in connection with a four-cylinder engine. FIGS. 8 and 9 depict the invention as used in a six- or eight-cylinder engine.

FIG. 1 shows the ferrous casting or crankshaft 10 from a four cylinder engine, which is typically supported by five main bearings. The crankshaft 10 of FIG. 1 includes four tubes 12, 14, 16, and 18 which act as the lubricant passages. These tubes are cf a material, such as steel, compatible with the ferrous casting which is made by the process of the invention.

These tubes must be of a material that is compatible with the metal that will ultimately comprise the finished ferrous casting. In the context of this embodiment, compatibility is intended to mean that the metals of the tube and of the casting shall form a good metallurgical bond. Thus, when completed, the several tubes within this ferrous casting are metallurgically bonded to the casting itself. One method of ensuring this metallurgical bonding is by the copper coating or plating technique described at columns 5 and 6 of U.S. Pat. No. 4,749,624, which is incorporated herein by reference.

Figure 2:
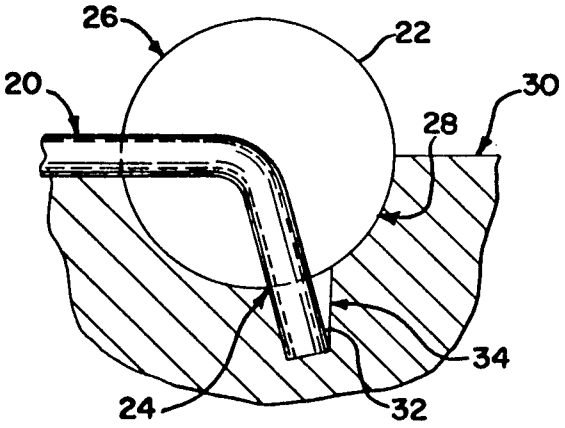
FIG. 2 is a section through the mold of FIG. 1, but before the molten metal has been inserted, and with the tubing for the lubricating passage in place, with that tubing projecting through the supporting ring at an angle normal to that ring and to the bearing surface which that ring will ultimately encompass.

Referring now to FIG. 2, in the method embodiment of this invention, a steel tube 20 is first secured to a thin ring 22. In this embodiment, the tube 20 projects through thin ring 22 at an angle normal to the surface of the bearing journal. Ring 22 is thin, and of a generally cylindrical shape. Its carbon content is sufficiently low so that it is not significantly affected by heat treatment.

Typically, this tube 20 is secured to this thin ring with a welded or brazed joint 24. When finally secured, the tube 20 and ring 22 together form what shall be termed a tube-containing ring 26. In FIG. 2, the tube-containing ring 26 shown is disposed at the crankpin end of the crankshaft.

After it has been fabricated, this tube-containing ring 26 is placed in a ring recess 28 within a mold 30 for the ferrous casting. This ring recess 28 is custom-made within each mold-half to correspond to the shape and size of the tube-containing ring 26.

One auxiliary method of locating the tube-containing ring 26 within the mold-half is by inserting a distal end portion 32 of that tube into a tube recess 34 within the mold. In the embodiment of FIG. 2, the distal end 32 of the tube enters this tube recess 34.

During the casting procedure, molten metal being poured into the mold could enter the open distal end portion 32 of the tube. That molten metal, upon solidification within the tube, could result in its obstruction or total blockage. To minimize this possibility, about 0.5 to 1.0 mm of the distal end portion 32 of the tube 24 is pressed into the mold 14, sealing that end and preventing the molten metal from entering and blocking the tube. This pressing into the mold is known as "mold crush."

Figure 3:
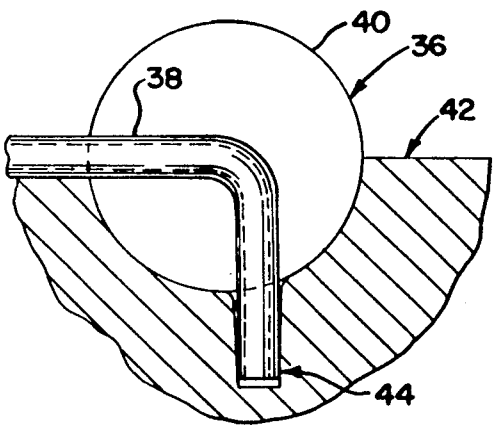
FIG. 3 is a sectional view similar to the sectional view of FIG. 2, but with the tubing projecting through the supporting ring at an angle perpendicular to the pattern plate line of the mold.

FIG. 3 is similar to FIG. 2, but shows a tube-containing ring 36 whose tube 38 projects through its corresponding ring 40 at an angle perpendicular to the pattern plate line of mold 42. The distal end 44 of this tube 38 is also embedded about 0.5 to 1.0 mm into the surface of that mold 42 to deter iron from entering and blocking that tube.

Occasionally, a tube within its tube-containing ring may be disposed at an angle to the pattern plate line of the mold such that mold crush would be ineffective in sealing the end of the tube from the entry of molten metal. In such circumstances, as may be seen in FIG. 4, the distal end 46 of tube 48 is butt-welded to the inner surface of its tube-containing ring 50 to form a molten metal-tight seal.

Figure 5:
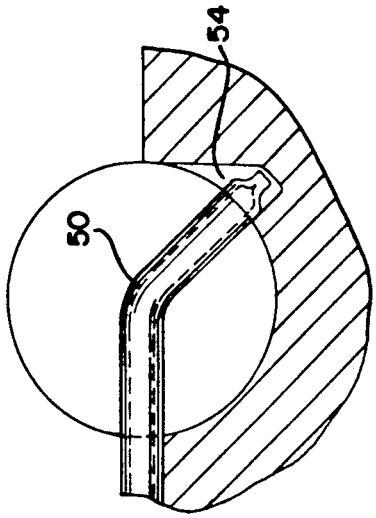
FIG. 5 is a sectional view similar to that of FIG. 4, but with the tube at an angle normal to and protruding through the supporting ring, with the end of that tube crimped closed to effect a seal from the entry of iron during the casting process.
Figure 4:
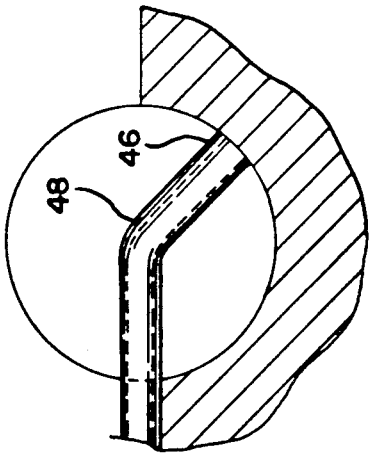
FIG. 4 is a sectional view similar to that of FIG. 2, but showing a tube at an angle to the pattern plate line such that mold crush will not effectively seal the end of the tube from the entry of iron into that tube during the casting process.

Yet another way of preventing the entry of molten metal, such as iron, into a tube is shown in FIG. 5. Here, the tube 50 is disposed at an angle normal to the bearing journal, but at an angle to the pattern plate line such that mold crush will not effectively seal the open end from iron entry. In such a case, the distal end 52 of tube 50 is inserted into tube recess or mold clearance 54. That end 52 is crimped, and that crimping prevents iron entry.

All of the above discussion has pertained to the use of the present method in connection with conventional, horizontal molds. FIGS. 6-9 show the use of the present method in connection with vertically parted molds, such as used in Disamatic mold machines.

Figure 6:
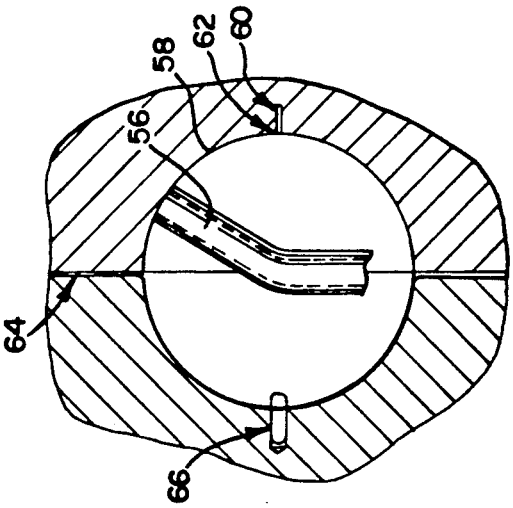
FIG. 6 is a section through a vertically parted mold, and of the tube setting fixture required to secure a tube within such a mold.

FIG. 6 shows a section through a vertically parted mold, and the fixture required to set a tube into place in this type of mold. In this Figure, the tube 56 is welded or brazed to support ring 58 to prevent iron entry during casting. A core retaining pin 60 secured to ring 58 by a welded or brazed joint 62 retains the tube 56 in the mold until that mold is closed. Also shown in FIG. 6 are a tube setting fixture 64, generally made of plastic or aluminum; and a locating dowel 66 in the tube setting fixture 64, which protrudes through a close-fitting hole in the support ring 58. This fixture 64 assists in the endwise location of the tube 56.

Figure 7A:
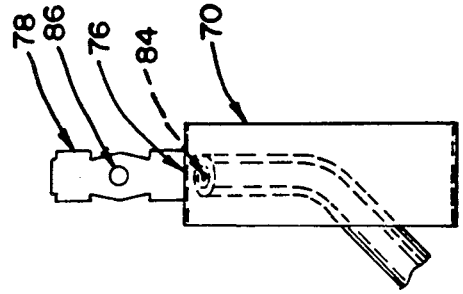
FIG. 7 and 7A depict yet another section through a vertically parted mold, and of another tube setting fixture required to secure a tube within such a mold.
Figure 7:
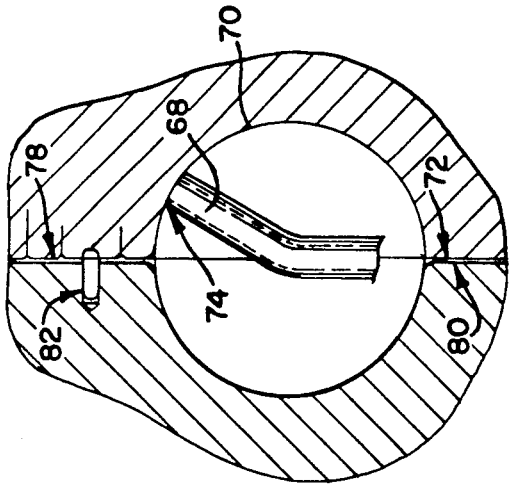

FIG. 7 is a section through a vertically parted mold generally similar to that of FIG. 6, and which includes the tube setting fixture required to place a tube in this type of mold. FIG. 7 illustrates an alternate method of locating the tube and retaining it in the mold.

Depicted in FIG. 7 is a tube 68 which has been butt-welded to a support ring 70 adjacent a crankpin end of a crankshaft. The tube 68 and support ring 70 are retained in a sand mold 72. A welded joint 74 attaches the tube 68 to the support ring 70 and seals the tube 68, deterring the entry of iron into the tube 68 during casting. Yet another welded or brazed joint 76 attaches the tube retaining clip 78 to the support ring 70. A tube setting fixture 80 is provided, as is a locating dowel 82 in the tube fixture 80. Here, this dowel 82 protrudes through a close fitting hole in the tube retaining clip 78, thereby facilitating endwise location for the tube 68.

The tube vent hole 84, typically 0.8 to 1.6 mm in diameter, is required to vent the tube 68 and support ring 70. The tube locating and retaining clip 78, typically stamped from 0.5 mm steel, includes a locating hole 86 which is punched at the same time the clip 78 is formed.

Figure 8A:
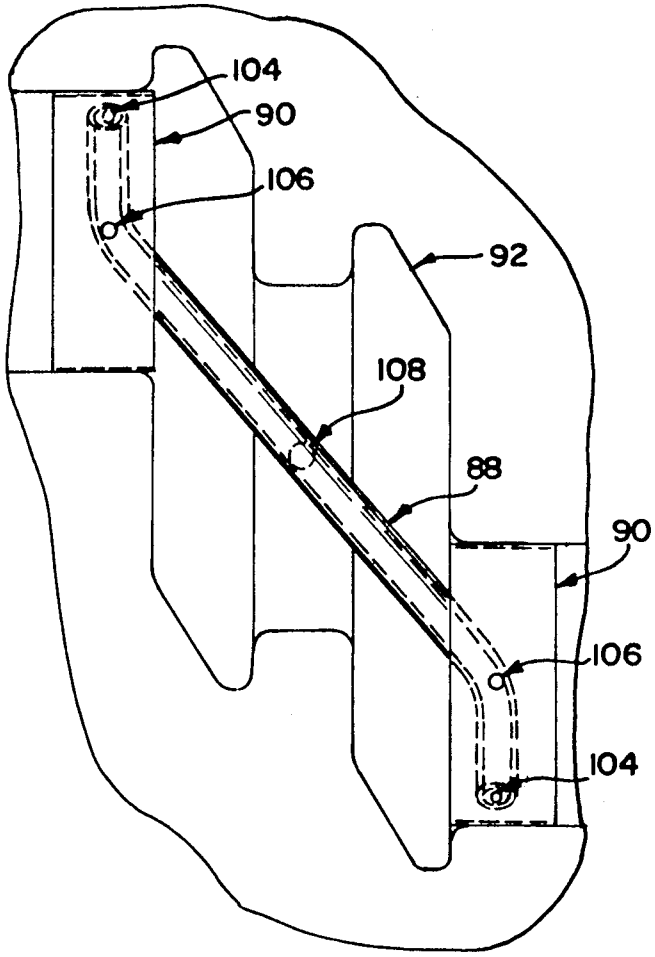
FIGS. 8 and 8A are a plan view and a sectional view of a three-piece tube, such as would be used in an automotive or other crankshaft for a V-6 or V-8 engine, and of the details required to set such a tube in a vertically parted mold.
Figure 8B:
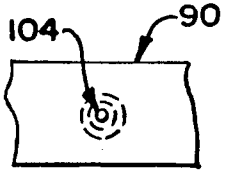
FIG. 8B is an end view of a portion of FIG. 8A.
Figure 8:
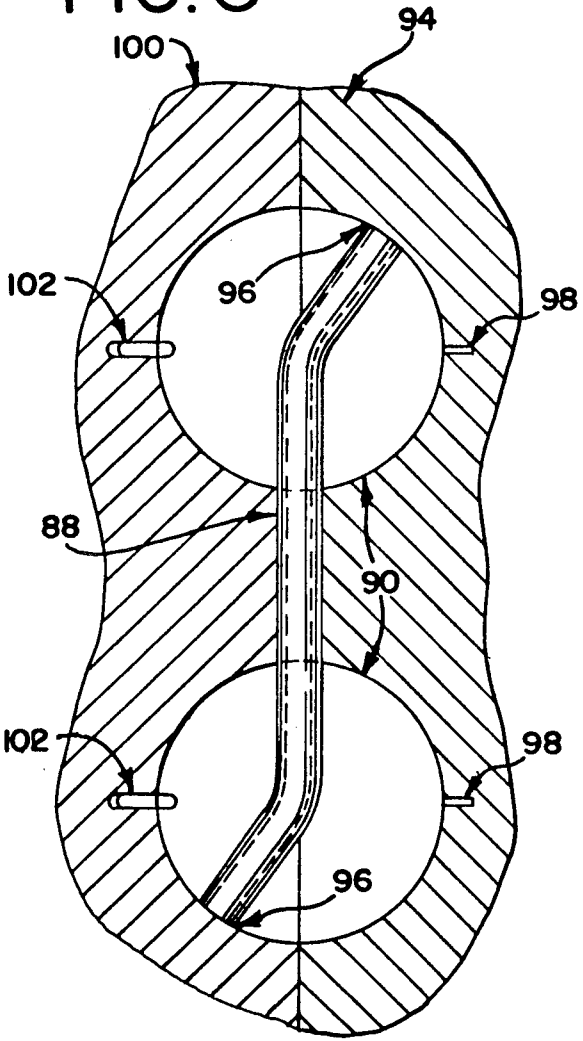

FIG. 8 is a plan view and section of a three-piece crankpin-to-crankpin tube, such as would be used in the crankshaft for a V-6 or V-8 type engine. Also shown are details of the necessary arrangement to place such a tube in a vertically parted mold. Illustrated are the tube 88 and the two support rings 90 at the crankpin end of the crankshaft. FIG. 8A shows the mold cavity/casting outline 92 within the sand mold 94. A pair of welded joints 96 attaches the tube 88 to the supporting rings 96 and seals the ends of the tube 88 from iron entry.

A pair of tube retaining pins 98 supports and retains the tube in the mold 94 until that mold is closed. Also shown are a tube setting fixture 100. Locating dowels 102, which protrude through a close fitting hole in the tube support rings 90, are provided for the tube fixture 100. Tube vent holes 104, having a diameter of from 0.8 to 1.6 mm, are required to vent internal pressure from the tube 96. This is because both ends of the tube are sealed by butt welding Locating holes 106 in the support rings 90, together with the locating dowels 102, locate the tube 88 in the tube setting fixture 100. In this manner, the tube 88 is placed at a preferred location in the plane of the main bearing.

In the FIG. 8 embodiment, the tube is routed from crankpin to crankpin through the center of the main bearings. The oil supply passage from the main bearing surface to the tube is formed during the machining operation by cross drilling the main bearing journals. This results in a three-piece assembly and does not appreciably increase machining costs.

FIG. 9 is a plan view and section of a five-piece (crankpin to main bearing/main bearing to crankpin) tube design for a V-6 or V-8 type engine. As with the other embodiments described above, this embodiment eliminates the cross drilling required by other prior art designs.

FIG. 9 shows the details of the necessary arrangement to place this type of tube in a vertically parted mold. A pair of tubes 110 are secured at welded joints 112 to rings 114 at the crankpin ends of a crankshaft. These welded joints prevent the entry of iron or other molten metal into one of the ends of these tubes 110 during casting. In this type of crankshaft, a tube support ring 116 is also provided for the main bearing end.

Figure 9A:
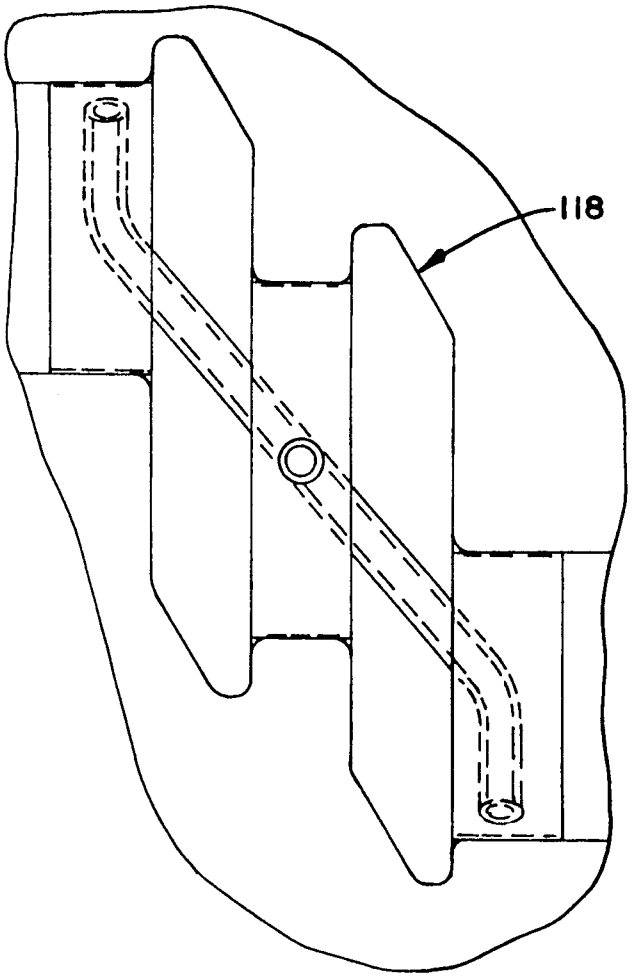
FIGS. 9 and 9A are plan and sectional views of a five-piece tube design for a V-6 or V-8 engine, which design eliminates the need to cross-drill.
Figure 9:
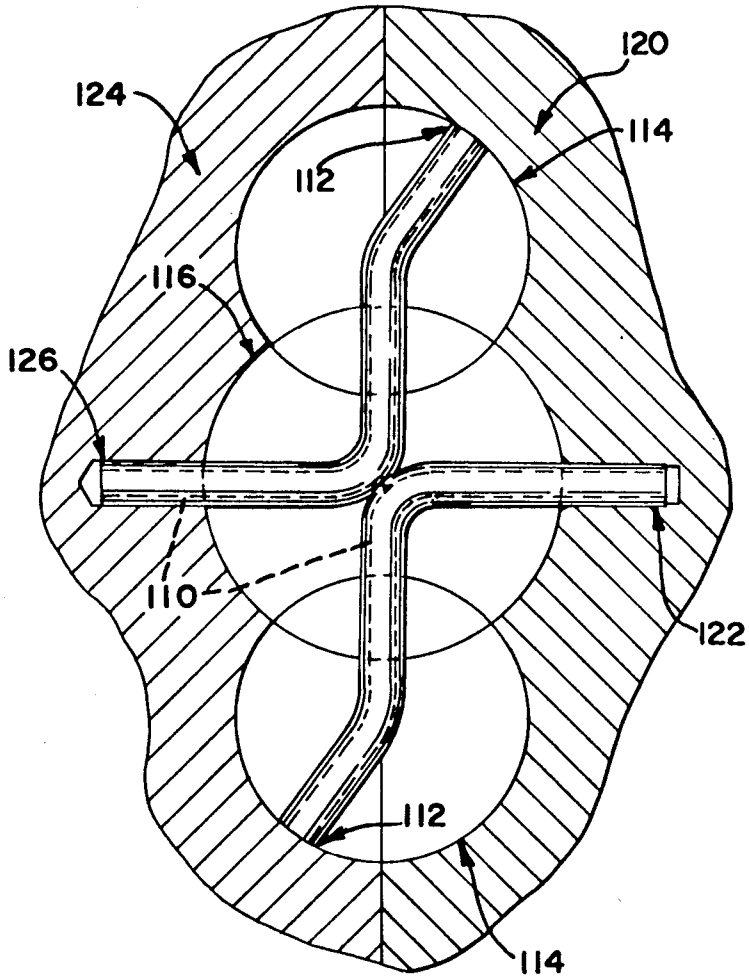

FIG. 9A shows the casting outline 118 of the crankshaft within a cavity of the sand mold 120. An area of intentional mold interference, or crush, presses the other open ends of the tubes 110 about 0.5 to 1.0 mm into the mold, sealing those ends and preventing iron from entering and blocking and tubes 110. Again, welded or brazed joints are provided where the tubes 110 pass through the supporting ring 116 for the main bearing end, and secure the tubes to that ring.

Also shown are a tube setting fixture 124 and the locating and tube clearance hole 126 in that fixture. This type of tube uses its projecting ends for both locating within the tube setting fixture, and for its own retention within the mold until that mold is closed.

After the tubes have been retained within the mold in accordance with any of the methods described above, molten metal such as iron is poured into the mold to form the casting.

Finally, the completed ferrous casting is removed from the mold when the molten metal has solidified.

As explained above, the rings on these completed castings are of a sufficiently low carbon content so that they are note significantly affected by heat treatment. Accordingly, after casting has been completed, they may be removed from the casting itself.

The rings are placed within the mold in a position circumscribing the crankshaft bearing journals. Thus, after casting, the solidified bearing journals are covered by these rings.

Subsequent to its solidification, and after the removal of these rings, e.g., rings 114, from the casting, all that remains of the tube-bearing ring is the tube 110 itself. The distal end of the tube 110 coincides with, and during operation of the crankshaft enables the lubrication of the surface of, the bearing journal.

Several general principles should be borne in mind in the practice of the present invention. First, the placement of the tubes can be normal to the cast bearing journal surface, as shown in FIG. 2; or at an angle perpendicular to the pattern plate line, as shown in FIG. 3.

When placed normal to the cast surface, deburring and chamfering operations are easier. However, such placement requires a slightly more complex tube assembly. Particularly, the tube must be bent in two planes. Moreover, if the exit angle to the plate line is too severe, the tube may need to be crimped shut (FIG. 5), or butt welded (FIG. 4) to the inside of the ring to keep molten iron from entering that tube.

When the tube is placed at an angle perpendicular to the pattern plate line, the deburring and chamfering operations become more difficult, but tube assembly is simpler. Because both ends of the tube are disposed in a single plane perpendicular to the pattern plate line, it is easier to both set the tube-ring assemblies into the mold and seal the ends of the tube from iron entry.

The location of the main bearing oil entry hole, in contrast, is less sensitive. In the vast majority of cases, that hole may be placed close enough to the centerline to allow the tube to exit perpendicular to the surface of the bearing journal. It is axiomatic that the rings should be chosen with an outside diameter and width matching those of the rough bearing journal. Because bearing sizes do not generally correspond to the sizes of widely-available tubing, these rings will instead generally need to be custom rolled from flat metal stock. Exit holes for the tubing can be struck during the manufacture of ring blanks from the flat stock. The material thickness should not exceed one-third (⅓) of the finish allowance. Any plating of these rings should be performed prior to their assembly with the tubes.

The tube-containing rings can be precisely fixtured to improve their accuracy. Additional components to improve the ability to locate the rings within the mold can be added prior to their placement within the mold. If the tube is disposed perpendicular to the pattern plate line, then the distal end of that tube protruding through the ring is normally sufficient to locate and secure or retain the ring in a horizontal or vertically parted mold.

If the tube does not project through the ring, or if the projection through the ring is at an angle, then the tube-containing ring can be secured in the mold by the use of pins or stamped clips.

Single plane crankshafts, such as those used in automotive in line four cylinder engines (FIG. 1), typically require four separate tube-containing ring assemblies per casting. However, the two rear cylinders are mirror images of those at the front. For this reason, the same components can be used to produce the front and back assemblies, which keeps costs low.

In contrast are V-6 and V-8 multiplane crankshafts. These crankshafts may have but one assembly that is identical to the corresponding assemblies used in single plane crankshafts, i.e., the front main bearing to crankpin assembly and the rear main bearing to crankpin assembly. All other such assemblies are different.

In the crankshaft shown in FIG. 9, for example, the assemblies can be comprised of separate tubes for each crankpin. A ring is used for each bearing journal Hence, a five-piece assembly results.

An additional advantage to the present method of locating oil supply tubes is that the rings form the surface of the front and rear main bearings in all types of crankshafts. Because the dimensional tolerance of the tube-containing ring assemblies is independent of the casting process, the primary locating diameters can be controlled much more precisely than is possible with a conventional cast surface.

The locating diameters are also free of variations caused by mold shift and mismatch, resulting in a much more precisely located part for initial machining. This in turn allows better control over the static balance of the rough casting, and yields a reduction in the amount of material, cost, and additional machining and balancing operations required to ensure proper balance of the finished part.

While the specific embodiment has been illustrated and described, numerous modifications come to mind without markedly departing from the spirit of the invention. The scope of protection is thus only intended to be limited by the scope of the accompanying claims.

What is claimed is:

1. A method of forming a passage having a predetermined linear or non-linear shape in a ferrous casting, comprising:

a. securing a tube of a material compatible with said ferrous casting to a generally cylindrical supporting ring, said tube passing generally transversely through the outer surface of said ring, thereby forming a tube-containing ring;

b. placing said tube-containing ring in a recess within a mold for said ferrous casting;

c. pouring molten metal into said mold; and d. removing said completed ferrous casting, including said supporting ring, the surface of a portion of said casting being formed by said supporting ring, from said mold when said molten metal has solidified.

2. The method of claim 1, wherein said tube-containing ring is located within said mold by inserting a distal portion of said tube into a recess within said mold.

3. A method of forming a passage having a predetermined linear or non-linear shape in a ferrous casting, comprising:

a. securing a tube of a material compatible with said ferrous casting to a generally cylindrical supporting ring, thereby forming a tube-containing ring;

b. placing said tube-containing ring in a recess within a mold for said ferrous casting, said tube-containing ring being located within said mold by inserting a distal portion of said tube into a recess within said mold, said recess within said mold and containing said distal portion of said tube being of a diameter less than that of said tube;

c. pouring molten metal into said mold; and d. removing said completed ferrous casting from said mold when said molten metal has solidified.

4. A method of forming a passage having a predetermined linear of non-linear shape in a ferrous casting, comprising:

a. securing a tube of a material compatible with said ferrous casting to a generally cylindrical supporting ring, the entire circumference of at lest one end wall of said tube abutting against said ring, thereby forming a tube-containing ring;

b. placing said tube-containing ring in a recess within a mold for said ferrous casting;

c. pouring molten metal into said mold; and d. removing said completed ferrous casting, including said supporting ring, the surface of a portion of said casting being formed by said supporting ring, from said mold when said molten metal has solidified.

5. The method of claim 4, wherein said tube-containing ring is located within said mold by inserting a distal portion of said tube into a recess within said mold.

6. A method of forming a passage having a predetermined linear or non-linear shape in a ferrous casting, comprising:

a. securing a tube of a material compatible with said ferrous casting to a generally cylindrical supporting ring, the circumference of said tube abutting against said ring, thereby forming a tube-containing ring;

b. placing said tube-containing ring in a recess within a mold for said ferrous casting by inserting a distal portion of said tube into a recess within said mold, wherein said recess within said mold and containing said distal portion of said tube is of a diameter less than that of said tube;

c. pouring molten metal into said mold; and d. removing said completed ferrous casting, including said supporting ring, the surface of a portion of said casting being formed by said supporting ring, from said mold when said molten metal has solidified.

* * * * *

UNITED STATES PATENT AND TRADEMARK OFFICE

CERTIFICATE OF CORRECTION

PATENT NO. : 5,129,444

DATED : July 14, 1992

INVENTOR(S) : Jerry E. Bafford

It is certified that error appears in the above-identified patent and that said Letters Patent is hereby corrected as shown below:

Abstract, line 1, delete "haing" and insert --having--

Column 1, line 41, after "drill" delete ","

Column 2, line 2, after "passage" insert --.--

Column 2, line 6, after "patent)" insert --.--

Column 2, line 30, after "using" delete "."

Column 3, line 53, after "crankpins" insert --.--

Column 5, line 54, after "welding" insert --.--

Column 8, line 36, delete "lest one" and insert --least an--

Signed and Sealed this

First Day of March, 1994

Bruce Lehman

*Attest:*

BRUCE LEHMAN

*Attesting Officer*

*Commissioner of Patents and Trademarks*